US010207265B2

(12) United States Patent
Hawes

(10) Patent No.: US 10,207,265 B2
(45) Date of Patent: Feb. 19, 2019

(54) MICROFLUIDIC DEVICE AND METHOD OF MANUFACTURE

(71) Applicant: Eleanor Augusta Hawes, Lexington, KY (US)

(72) Inventor: Eleanor Augusta Hawes, Lexington, KY (US)

(73) Assignee: Hummingbird Nano, Lexington, KY (US)

( * ) Notice: Subject to any disclaimer, the term of this patent is extended or adjusted under 35 U.S.C. 154(b) by 0 days.

(21) Appl. No.: 15/457,239

(22) Filed: Mar. 13, 2017

(65) Prior Publication Data

US 2017/0259261 A1 Sep. 14, 2017

Related U.S. Application Data

(60) Provisional application No. 62/306,693, filed on Mar. 11, 2016.

(51) Int. Cl.
*B01L 3/00* (2006.01)

(52) U.S. Cl.
CPC ..... *B01L 3/502707* (2013.01); *B01L 2200/12* (2013.01)

(58) Field of Classification Search
CPC ..... B01L 2200/12; B01L 3/502707
See application file for complete search history.

(56) References Cited

U.S. PATENT DOCUMENTS

| | | | | |
|---|---|---|---|---|
| 5,556,554 | A * | 9/1996 | Morishita | B23H 7/02 219/69.12 |
| 2003/0214057 | A1* | 11/2003 | Huang | B01J 19/0093 264/1.1 |
| 2005/0212878 | A1 | 9/2005 | Studer | |
| 2006/0127743 | A1 | 6/2006 | Lee | |
| 2007/0212266 | A1 | 9/2007 | Johnston | |
| 2008/0185043 | A1* | 8/2008 | Prins | B01L 3/502707 137/2 |
| 2012/0193234 | A1 | 8/2012 | Prabhakar | |
| 2014/0191438 | A1 | 7/2014 | Fourkas | |
| 2015/0050179 | A1* | 2/2015 | Hawes | B22F 5/007 419/38 |

* cited by examiner

*Primary Examiner* — Dennis White
*Assistant Examiner* — Bryan Kilpatrick
(74) *Attorney, Agent, or Firm* — Tungsten IP

(57) ABSTRACT

A microfluidic device molded in a single step provides a seamless fluid communication path from fluid input features to microfluidic channels. The device comprises a molded material which is formed around thread for forming high aspect ratio microfluidic channels. An associated method for the manufacture of the device is also provided.

7 Claims, 5 Drawing Sheets

Detail A

Reverse image

Detail B

Reverse image

MICROFLUIDIC DEVICE AND METHOD OF MANUFACTURE

STATEMENT REGARDING FEDERALLY SPONSORED RESEARCH

This invention was made with Government support under Award #1555996 awarded by the National Science Foundation. The Government has certain rights to this invention.

BACKGROUND

1. Field of the Disclosure

The present disclosure generally relates to the micro-technology field and, more specifically, to a microfluidic device and associated method of manufacture via a form of inverse molding.

2. Description of the Related Art

Current technology for the manufacturing of micro-technology is often realized in a series of methods such as Solid Freeform Fabrication. In these methods, material is deposited or built up gradually as required to form the desired shape and structure, such that only the amount of material required for the final device is used, and the end product is created as one piece.

A related method of micro-technology manufacturing and shaping is three-dimensional molding using magnetically activated ferrofluids. In this method, described generally in U.S. patent application Ser. No. 14/460,573, a substrate comprises a fluid with ferromagnetic properties, such that the application of external magnetic fields can form the substrate into a desired shape and position within a 3-D volume and the material intended for use in the final product may be molded and cured against that specific shape.

Microfluidics are in the technical field of micro-technology which involves the processing of low volumes of fluid on a microscopic scale, and can be used in inkjet printing, DNA microarray analysis, thermal technologies, and numerous other applications as known in the art. These devices are provided with small channels for the transportation and mixing of fluids, in addition to various other fluid processes. Manufacturing of these channels, however, must typically be accomplished by molding or etching multiple open microfluidic channels on different pieces, which are then bonded or sealed together to form the completed component. This not only limits the orientation and placement of microfluidic channels within a component or device, particularly with respect to the terminal ends and interfaces of such channels, but also requires additional manufacturing steps while introducing a weakened plane along the bond surface.

Therefore, devices featuring integral channels and terminal interfaces which may be manufactured in a single piece represent a substantial advance in the art. Such a device and associated method of manufacture is the subject of this disclosure.

SUMMARY

The present disclosure provides microfluidic devices which allows for the reduction of connectors, interfaces, and fabrication steps during the manufacturing process. The devices are manufactured via a process wherein the interior features of the microfluidic chip, including channels and channel interfaces such as fluid inputs, are molded or otherwise produced in a single step.

The devices disclosed herein comprise a molded object which contains fluid input features and integral channels connected directly. This allows for the use of fluid input connector styles such as pipette tips, luers, mini-luers, or threaded connectors as known in the art. Due to the integration of fluid input features, these connectors may be used without requiring additional elements during fluid insertion. Additional elements include edge seals and tube-to-fluid connectors.

The devices disclosed herein further allow for the seamless insertion of fluid from the connector to the channel, as both the fluid input and channel are manufactured in a single step. Due to the seamless nature and tight fit of the insertion method, "dead volume", which is an unnecessary volume of fluid based on the intended microfluidic purpose, is reduced because fluid can be moved directly from the source to the channel, bypassing losses that occur through connectors and tubing, as well as residue in the wells. The seamless nature inherently provides for precision alignment of the fluid input nozzle to the fluidic channel, thus eliminating additional steps that would be required to achieve the same alignment.

The devices disclosed herein further allow for three-dimensional positioning of the fluid input with respect to the microfluidic devices.

Additionally, the present disclosure provides a method of manufacture for the devices disclosed herein, enabling the devices to be molded in a single step.

The method disclosed herein comprises the step of using a solid material or thread as a form substrate and shaping the molding material around that form.

The method disclosed herein allows for molding channels to create a junction, the wetting between the solid materials being enabled by a surfactant which wets completely with the molding material such that the molding material forms around the two or more solid materials and not between them.

The method disclosed herein allows for the molding of channels such that if the solid materials are placed on top of one another, the molding material forms completely around the solid materials and no junction is formed.

The method disclosed herein allows for molding wherein the mold form is interior to the molding material.

The method disclosed herein generally allows for the seamless manufacture of microfluidic channels without the requirement of alignment or bonding steps.

The features and advantages of the present disclosure will be more understood through the detailed description and in reference to the figures which follow.

DETAILED DESCRIPTION

It is to be understood that various omissions and substitutions of equivalents are contemplated as circumstances may suggest or render expedient, but these are intended to cover the application or implementation without departing from the spirit or scope of the claims of the present invention. It is to be understood that the present invention is not limited in its application to the microfluidic device and method of manufacture set forth in the following description. The present invention is capable of other embodiments. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item. It is also to be understood that the use of the terms "channel", "well", "microfluidic device", "filament, "substrate", "wetting" and associated terms known in the art should be interpreted as generally descriptive of the disclosure herein rather than as limiting.

The present disclosure provides fluid input features (such as 11 or 13) as integrally molded components of a microfluidic device. Fluid inputs, referred to as "wells" by those known in the art, serve to provide open access points for the deposition of fluid into the channels of microfluidic devices and may often be cylindrical or conical in shape. Because these fluid inputs are often significantly larger than the channel features, they allow insertion of various instruments or sealing connectors for the deposition of fluid.

Figure 1:
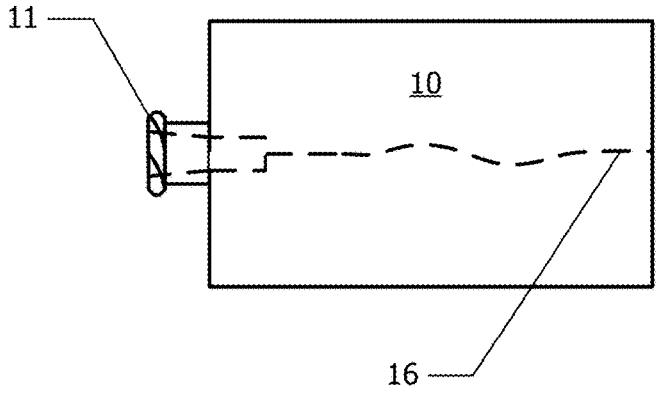
FIG. 1 is a side view drawing of a device disclosed herein, showing generally the integral molding of a fluid input device using a male luer as an exemplary model.

In the present disclosure, fluid inputs may be molded integrally with the microfluidic device and styled to a particular connector type, as depicted generally in FIG. 1. This eliminates the need for intermediate fluid inputs between the fluid dispersing unit and the microfluidic device. In applications where capillary or vacuum force is used to draw fluid into the microfluidic device, the need for a seal is eliminated entirely. Moreover, fluid inputs may be manufactured in substantially any three-dimensional orientation or position, allowing positioning of connectors or fluid input units as desired for any configuration or application. The fluid input to microchannel molding also allows for the application of pressure. For example, if using a pipette, you can insert the pipette and then depress the pipette release. This will pressurize the channels, enabling them to fill quickly. Open style wells may rely on capillary action, and other methods require the connectors and tubing to reach the pressure source.

The device provided in the present disclosure reduces dead volume due to the elimination of connectors which would otherwise be required between fluid input units and microfluidic channels.

Applications for devices disclosed herein may be better understood by reference to FIG. 1, wherein a microfluidic device 10 has been provided with a female luer connector 11, leading directly into a microfluidic channel 16 that is characterized by having a very high aspect ratio (length/cross-sectional width). The transition from the female luer connector 11 to the microfluidic channel 16 is abrupt, with little to no dead volume that is typical with threaded connectors. The female luer connector 11 is one of many connectors that may be integrally molded. For example, male luer connectors, barbed connectors, straight connectors, and bent connectors are capable of being integrally molded in connection with a microfluidic channel 16 as shown.

Figure 1A:
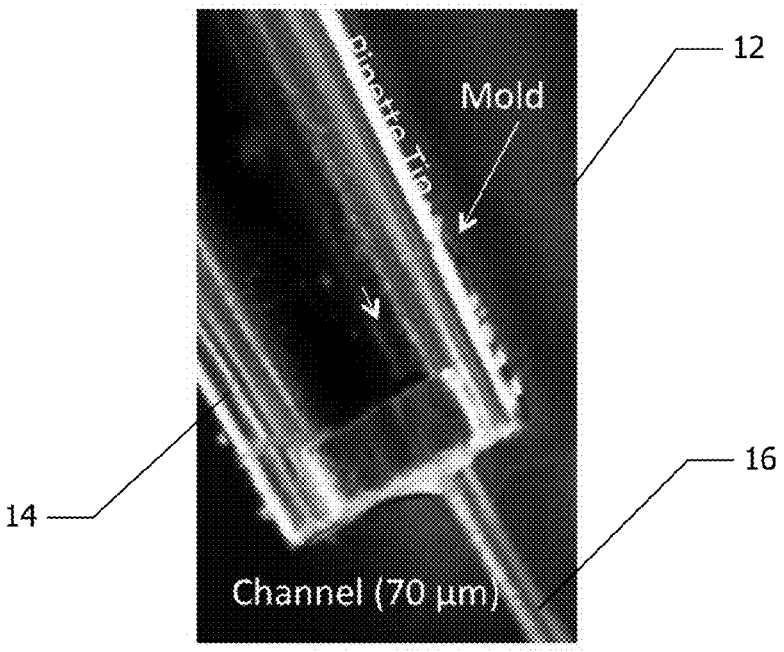
FIG. 1*a* is a magnified top-perspective photograph of a device disclosed herein, showing the molded microfluidic device receiving a pipette tip using an integrally-molded coupling feature leading directly to a fluid channel.
Figure 1B:
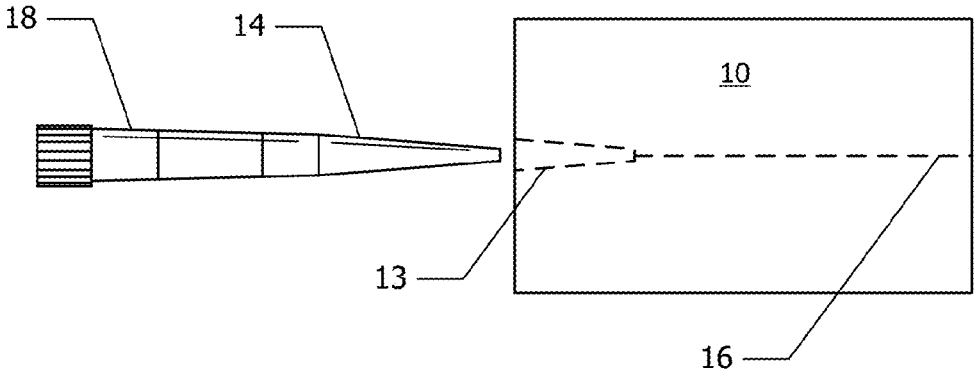
FIG. 1*b* is a top-perspective drawing of the device shown in FIG. 1*a*.

FIG. 1*a* is a magnified top-perspective photograph of a molded microfluidic device 10 shown with a pipette 18, including a pipette tip 14. A custom pipette receiver 13 is sized to fit tightly with the pipette tip 14. The pipette receiver 13 is fluidically coupled to a microfluidic channel 16. Because the pipette receiver 13 is integrally molded as part of the device 10 and is styled to match the pipette tip 14, a coupling may be achieved without the use of intermediate adapters or additional devices. Additionally, the coupling of the pipette 18 with the device 10 may have extremely precise alignment with low tolerances to ensure a complete seal. Although the device 10 is depicted in this example with coupling to a pipette 18, it should be understood that the device 10 disclosed herein may be molded with the intent of coupling to substantially any instrument or connector for the purpose of allowing fluid input.

In practice, microfluidic channels have been molded by the inventors in one step with aspect ratios of more than 100:1. This is not possible with conventional molding techniques. In many cases, molding microfluidic channels with conventional methods to achieve an aspect ratio of even 5:1 can be challenging.

Figure 2A:
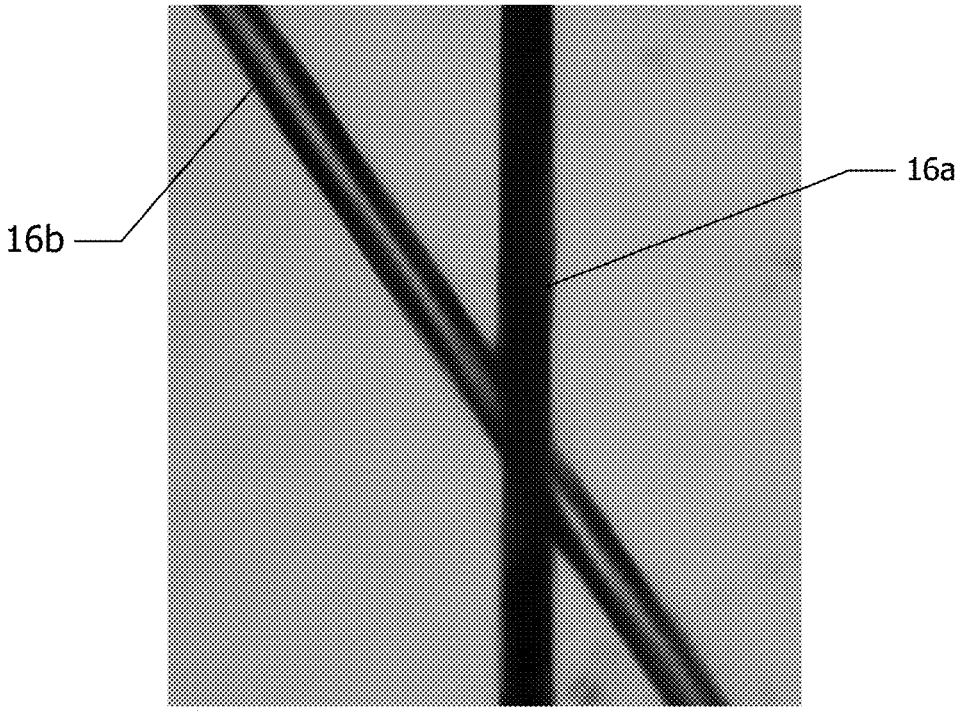
FIG. 2*a* is a magnified top-perspective photograph of the device disclosed herein, showing two microfluidic channels crossing, wherein one channel crosses the other without cross-contamination of the fluid passing through one of the channels.
Figure 2B:
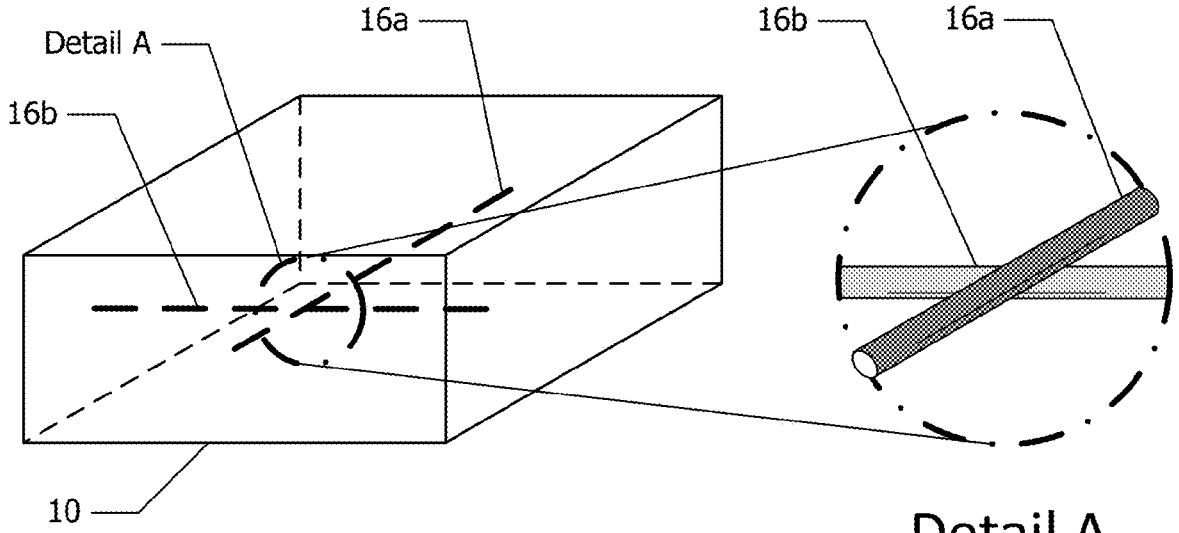
FIG. 2*b* is an alternative perspective drawing of the device shown in FIG. 2*a* for improved clarity.

An additional application of the device 10 disclosed herein may be better understood by reference to FIGS. 2*a* and 2*b*, showing two microfluidic channels 16*a*, 16*b* crossing close to each other without communication within the molded device 10. As shown, the device 10 may be provided with multiple channels in different orientations and alignments. FIGS. 2*a* and 2*b* show that the device 10 may be provided with two channels 16*a*, 16*b* crossing in close proximity without communication. The lack of communication between the two channels 16*a*, 16*b* is depicted in FIG. 2*b* by the use of alternate shading.

Figure 3A:
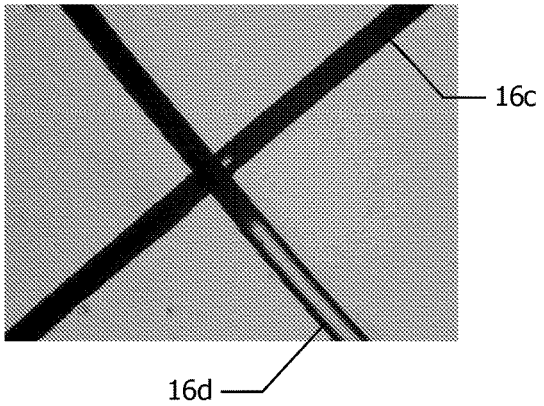
FIG. 3*a* is a magnified top-perspective photograph of the device disclosed herein, showing two microfluidic channels crossing, having fluid communication between the two channels.
Figure 3B:
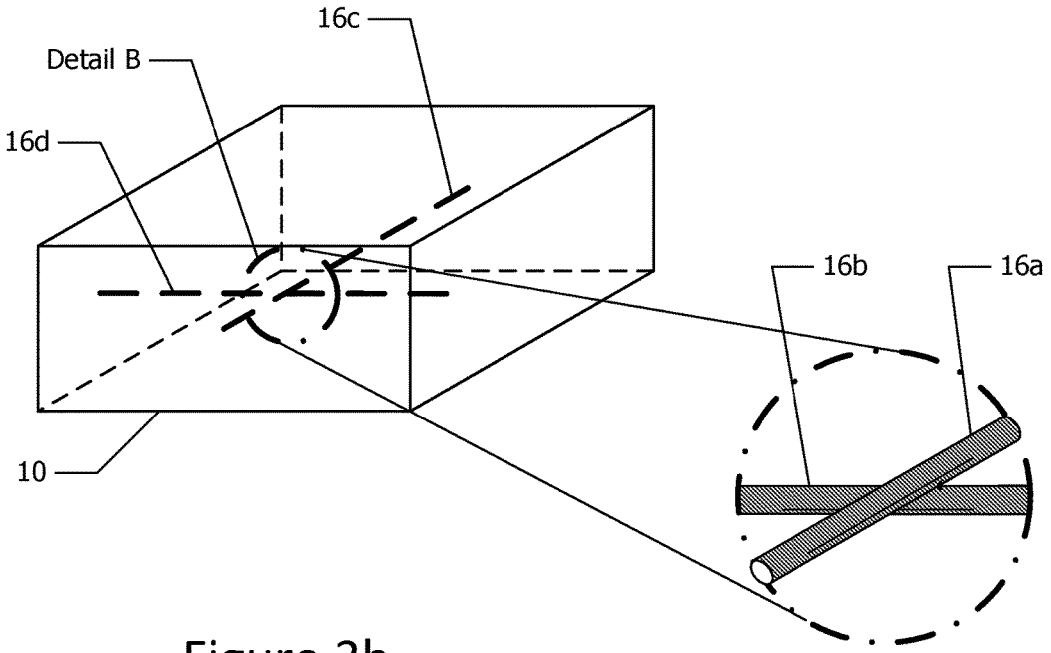
FIG. 3*b* is an alternative-perspective drawing of the device shown in FIG. 3*a*.

A further application of the device 10 disclosed herein may be better understood by reference to FIGS. 3*a* and 3*b*, showing two microfluidic channels 16*c*, 16*d* crossing, or intersecting, each other with communication within the molded device 10. FIGS. 3*a* and 3*b* show that by the use of inherently low surface energy thread (low wetting), or by modifying the surface energy to create a low surface energy thread, microfluidic channels crossing in close proximity may form a gap in the molded material, resulting in fluidic communication between microfluidic channels 16*c* and 16*d*, allowing fluid to flow from one channel to another. This is referred to as a "microfluidic bridge". Communication between the two microfluidic channels 16*c* and 16*d* are depicted in FIG. 3*b*, Detail B, by the use of the same shading. The device is not limited to two such channels as shown in FIGS. 3*a* and 3*b* but may include two or more such channels or multiple combinations of communicating and non-communicating channels.

Although not shown in the Figure, a microfluidic bridge will most likely be accompanied by corners having radii in the region of the microfluidic bridge. These radii may be dimensionally tuned through the balance of thread surface energies and molding material surface tension. It may be that the radii may be tuned to prefer one microfluidic channel (such as 16*c*), resulting in non-symmetric radii. Non-symmetric radii may be achieved by having a surface energy difference in the thread used to form channels 16*c* and 16*d*. For example, a thread with a higher surface energy (100 dynes/cm for example), to form channel 16*c*, in combination with a thread having a low surface energy (50 dynes/cm for example) will result a corner radii 18 that is non-symmetric.

A non-symmetric corner radius 18 may be useful for preferentially affecting flow or mixing in a microfluidic device.

Figure 4A:
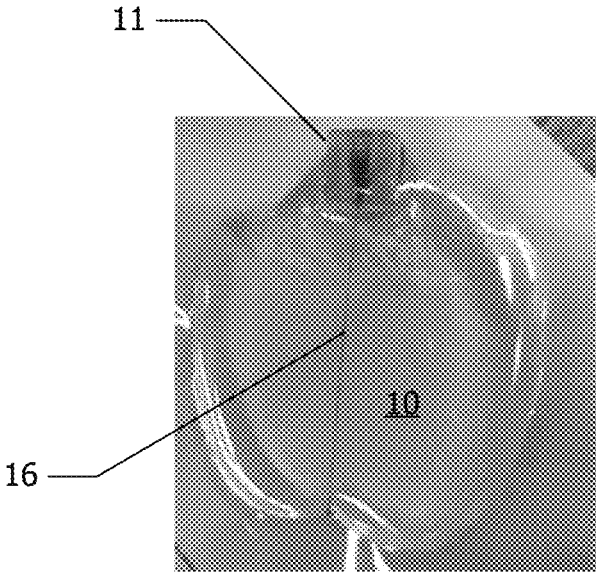
FIGS. 4*a* and 4*b* show photographs of implemented devices having a luer connector in communication with a microfluidic channel in different configurations.
Figure 4B:
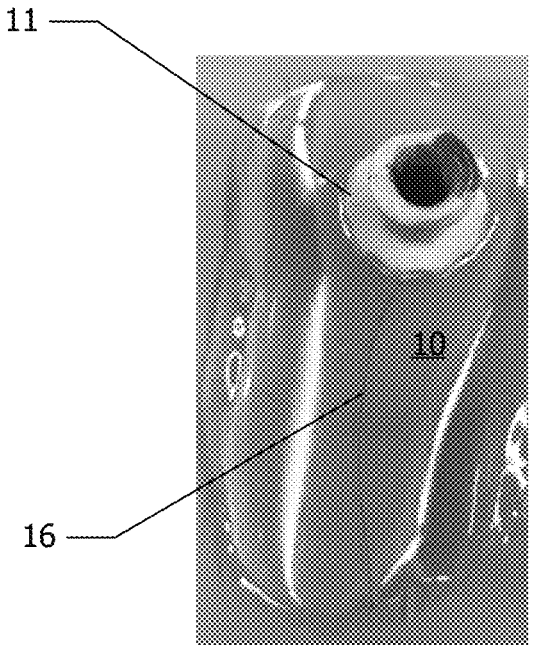

FIGS. 4*a* and 4*b* show photographs of a female luer connector 11 in fluidic communication with a high aspect ratio microchannel, having an aspect ratio of about 400 molded in a single step.

Formulas known in the art, such as the Fowkes formulation, may be utilized to determine whether a particular combination of molding material, thread, and surfactant will properly wet. The use of such formulas constitutes a step of the manufacturing method disclosed herein.

Testing may also be used to determine whether an appropriate combination has been identified. The use of such tests constitutes a step of the manufacturing method disclosed herein. The thread (not shown) used to form microfluidic channels (such as 16*c* and 16*d*) may be, as non limiting examples, polymeric materials (e.g., polyester, fluorocarbon, or nylon), or metallic (e.g., tungsten, copper, nickel, steel, or any available alloy). Other materials may be used as well, including natural fibers. The thread may be round in cross-section, or may be elliptical, square, or any such shape used to produce the desired microfluidic channel. Thread may be merely suspended, or held in tension. The thread need not be straight, but may include bends (as shown in FIG. 1) or corners. Such a non-linear thread may be preferred in instances where an increased fluidic resistance is desired, but may not be obtainable with a linear thread segment.

In addition to thread formed of a solid material such as polymeric or metallic materials, a shape controlled fluid or gel such as a ferrofluid energized within a magnetic system may be used to hold a position and shape. The removal of which is simplified by removing the magnetic system and rinsing the channel. Devices and methods are taught in commonly owned U.S. patent Ser. No. 14/460,573 incorporated herein by reference.

Removal of the thread may be accomplished by tension, tension combined with heating, dissolution, or any similar method. For the purpose of reduction of steps in the manufacturing process, the method of tension without additional heating is preferred.

It should be appreciated that in certain applications, the removal of the solid material may be accomplished prior to the completion of the curing process.

It should be appreciated that the present disclosure additionally provides a method for the manufacture of the devices herein, which may be understood more specifically in the following description.

The method provided herein broadly comprises the following steps:

1. Providing a molding material suitable for the molding of a microfluidic device. Optionally preparing the molding material for those materials that may require mixing, for example.
2. Selecting thread of the preferred cross-sectional profile and surface energy, or optionally modifying the surface energy of the thread.
3. Providing a mold having one or more fluid inputs and one or more threads, wherein the microfluidic channels may be suspended by tension, surface wetting, or suspension.
4. Optionally providing a 3D magnetic system for shaping a microfluidic channel formed from a shape controlled fluid.
5. Introducing the molding material to the mold.
6. At least partially curing the molded material.
7. Separating the molded material from the mold.

It is contemplated, and will be clear to those skilled in the art that modifications and/or changes may be made to the embodiments of the invention. Accordingly, the foregoing description and the accompanying drawings are intended to be illustrative of the example embodiments only and not limiting thereto, in which the true spirit and scope of the present invention is determined by reference to the appended claims.

What is claimed is:

1. A method of manufacturing a single step molded microfluidic device, generally comprising the steps of:

a. providing a molding material suitable for the molding of a microfluidic device;
b. preparing the molding material prior to curing;
c. providing a mold having at least one fluid input and more than one thread for forming microfluidic channels, at least one of which is in fluidic communication;
d. optionally modifying the surface energy of at least one thread;
e. introducing the molding material to the mold;
f. at least partially curing the molded material;
g. separating the at least partially cured molded material from the mold.

2. The method of claim 1, wherein the thread may be selected from a group consisting of nylon, polyester, fluorocarbon, metals, ferrofluids and shape controlled gels.

3. The method of claim 2, wherein the separating of the thread may be accomplished by methods selected from the group consisting of tension, heating, chemical change, and dissolution.

4. The method of claim 3, wherein the separation of the thread may be aided by the application of a surfactant prior to the placement of the thread in the molding material.

5. The method of claim 4, wherein fluidic communication between more than one microfluidic intersecting channels is created by the use of threads having a surface energy of 50 dynes/cm or less in the molding material prior to curing.

6. The method of claim 5, wherein curing of the molding material is accomplished in a single step prior to the removal of the thread.

7. The method of claim 5, wherein curing of the molding material is accomplished in two or more steps, interrupted by the removal of the thread.

* * * * *